US006799518B1

(12) United States Patent
Williams

(10) Patent No.: US 6,799,518 B1
(45) Date of Patent: Oct. 5, 2004

(54) METHOD AND APPARATUS FOR FRANGIBLE PROJECTILES

(76) Inventor: Keith T. Williams, 333 Hart St., Edgefield, SC (US) 28924

( * ) Notice: Subject to any disclaimer, the term of this patent is extended or adjusted under 35 U.S.C. 154(b) by 0 days.

(21) Appl. No.: 10/686,201

(22) Filed: Oct. 15, 2003

(51) Int. Cl.[7] ..... F42B 12/40
(52) U.S. Cl. ..... 102/513; 102/516; 102/517
(58) Field of Search ..... 102/502, 513, 102/516, 517, 439

(56) References Cited

U.S. PATENT DOCUMENTS 5,237,930 A * 8/1993 Belanger et al. ..... 102/529
5,760,331 A 6/1998 Lowden et al.
5,763,819 A 6/1998 Huffman
5,767,438 A 6/1998 Lang et al.
5,852,255 A 12/1998 Hallis et al.
5,852,858 A 12/1998 Hallis et al.
5,913,256 A 6/1999 Lowden et al.
5,963,776 A 10/1999 Lowden et al.
6,024,021 A 2/2000 Schultz
6,090,178 A 7/2000 Benini
6,115,894 A 9/2000 Huffman
6,149,705 A 11/2000 Lowden et al.
6,174,494 B1 1/2001 Lowden et al.
6,263,798 B1 7/2001 Benini
6,308,607 B1 10/2001 Woodall et al.
6,317,946 B1 11/2001 Beal
6,722,283 B1 * 4/2004 Dindl et al. ..... 102/489

* cited by examiner

*Primary Examiner*—Charles T. Jordan
*Assistant Examiner*—T. Nguyen
(74) *Attorney, Agent, or Firm*—Dority & Manning, P.A.

(57) ABSTRACT

The preset invention discloses and claims a frangible projectile and method for delivering a wide array of selected agents to a target from stand-off distances. The frangible projectile includes fluorescent or optical powders and provides a method for covertly marking and detecting a target of interest. Alternately, the frangible projectile includes inert nano-powders and provides a method for preventing a high-order detonation of a target containing explosive material from stand-off distances.

11 Claims, 4 Drawing Sheets

METHOD AND APPARATUS FOR FRANGIBLE PROJECTILES

BACKGROUND OF THE INVENTION

Various devices and methods exist to deliver a selected agent to a target at limited distances with limited penetration of the target. For example, a tear gas gun or rifle can deliver a canister containing an agent to a target. These specialized, single-purpose instruments are limited to delivering only similarly specialized, single-purpose canisters. In addition, the specialized, single-purpose canisters contain a limited number of agents, such as CS2 or pepper spray. Moreover, the canisters' ballistic characteristics and structure necessarily limit the maximum effective range and penetrating capability for the canister.

Other devices and methods are capable of longer ranges and greater penetration, but generally have no capability for delivering a selectable agent to the target. For example, frangible bullets are available for virtually any caliber of weapon and are not limited to specialized, single-purpose weapons. The frangible bullets ballistic characteristics and structure generally permit increased range and penetration; however, they provide no ability for delivering a selected agent to the target.

For example, U.S. Pat. No. 6,263,798 issued to Benini and U.S. Pat. Nos. 5,852,255 and 5,852,858 issued to Hallis et al. describe frangible bullets designed to break apart with little or no penetration of the target. U.S. Pat. No. 6,024,021 issued to Schultz and U.S. Pat. No. 6,115,894 issued to Huffman describe frangible bullets that include one or more rods. In these designs, the frangible bullet penetrates the target before or during franging to allow the rods to continue along the delivery path and further penetrate the target. Although the frangible bullets described above provide additional range and penetrating capability, none of these frangible bullets is capable of delivering a wide array of selected materials, blended materials, or agents to the target.

SUMMARY OF THE INVENTION

Objects and advantages of the invention are set forth below in the following description, or may be obvious from the description, or may be learned through practice of the invention.

In one embodiment of the invention, a frangible projectile for covertly marking a target of interest includes primary components, a binding component, and active components. The primary components have a diameter between approximately 0.066 and 0.180 inches and a specific gravity greater than lead. The binding component substantially coats the primary components, and the binding component has a specific gravity less than lead. The active components include an optical marker that emits a predetermined wavelength that is not visible to a naked eye. The primary, binding, and active components are cold-pressed to form a ballistic shape having a specific gravity approximately equal to lead.

The invention also encompasses an improved method for covertly marking and/or detecting a target of interest. The method includes providing a ballistic cartridge including a frangible projectile containing an optical marker that emits a predetermined wavelength that is not visible to a naked eye. The ballistic cartridge is fired at and the frangible projectile impacts with the target of interest. The impact results in the frangible projectile breaking apart to release and disperse the optical marker on the target of interest. A sensor may then be used to detect the optical marker.

In another embodiment of the invention, a frangible projectile for preventing a high-order detonation of a target containing explosive material from stand-off distances includes primary components, a binding component, and active components. In this embodiment, the active components have a diameter less than approximately 0.006 inches and comprise silicon, silica dioxide, silicon carbide, titanium carbide, aluminum nitride, aluminum oxide, titanium dioxide, carbon, boron, aluminum, magnesium, iron, sulfur, or zirconium. The active components may be substantially homogeneously mixed with the primary and binding components during fabrication, or the active components may reside in a bore in the ballistic shape. The embodiment may further include a full-metal jacket, a long rod penetrator, an internal cup, and/or a base fuse initiator to provide additional penetrating ability of the target containing explosive material.

The invention further encompasses an improved method for preventing a high-order detonation of a target containing explosive material from stand-off distances. The method includes providing a ballistic cartridge including a frangible projectile containing an active component. The ballistic cartridge is fired at and the frangible projectile impacts with the target containing explosive material. The impact results in the frangible projectile breaking apart to release and disperse the active component proximate to the explosive material. The active component scavenges air proximate to the explosive material to prevent a high-order detonation.

Those of ordinary skill in the art will better appreciate the features and aspects of such embodiments, and others, upon review of the specification.

BRIEF DESCRIPTION OF THE DRAWINGS

A full and enabling disclosure of the present invention, including the best mode thereof to one skilled in the art, is set forth more particularly in the remainder of the specification, including reference to the accompanying figures, in which.

DETAILED DESCRIPTION OF PREFERRED EMBODIMENTS

Reference will now be made in detail to present embodiments of the invention, one or more examples of which are illustrated in the accompanying drawings. Each example is provided by way of explanation of the invention, not limitation of the invention. In fact, it will be apparent to those skilled in the art that modifications and variations can be made in the present invention without departing from the scope or spirit thereof. For instance, features illustrated or described as part of one embodiment may be used on another embodiment to yield a still further embodiment. Thus, it is intended that the present invention covers such modifications and variations as come within the scope of the appended claims and their equivalents.

The present invention relates generally to devices and methods for delivering a wide array of selected agents to a target from stand-off distances. The devices and methods are compatible for use with conventional small and large caliber firearms, as well as with larger delivery platforms such as those used in the military. Examples of selected agents are dyes, chemicals, diatomaceous earths, reactants, ceramics, powders, polymers, mixtures, compounds, and other basic elements of the periodic table, depending on the particular application.

Figure 1:
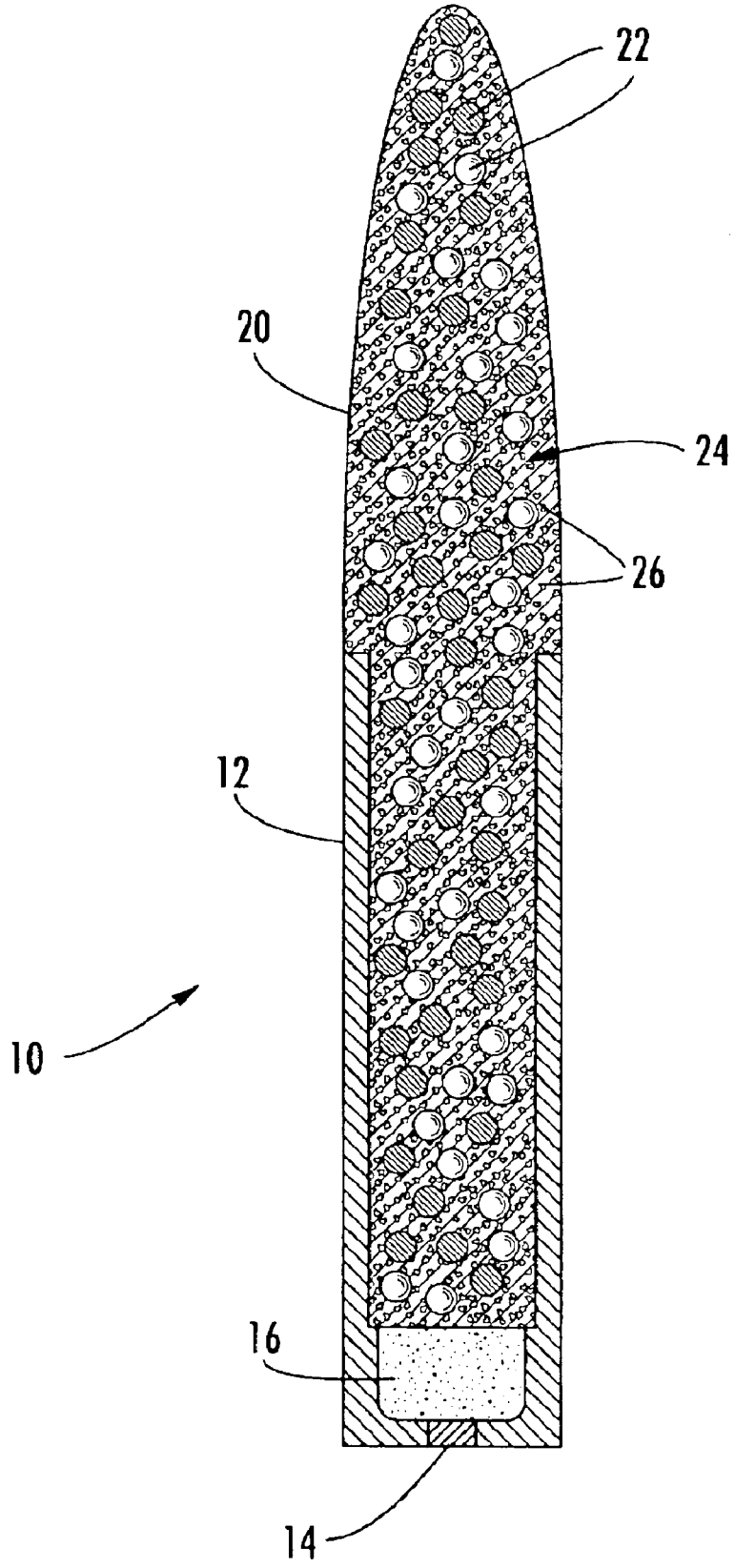
FIG. 1 is a side plan view of an embodiment of the present invention.
Figure 2:
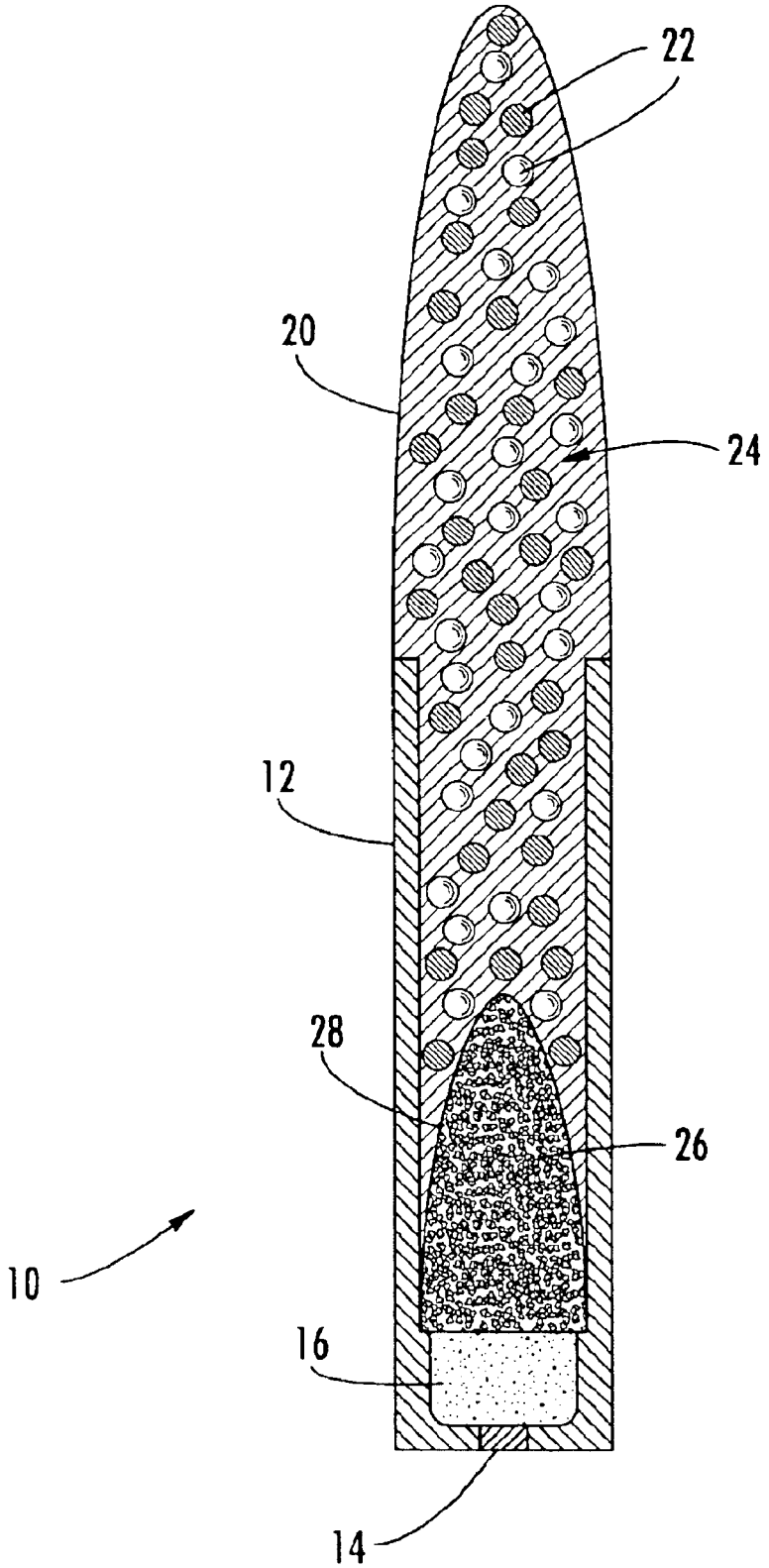
FIG. 2 is a side plan view of an alternate embodiment of the present invention.

FIGS. 1 and 2 illustrate an unjacketed center-fired cartridge 10 containing a frangible projectile 20 constructed according to an embodiment of the present invention. The cartridge 10 generally includes a casing 12, primer 14, propellant 16, and the frangible projectile 20. The casing 12, primer 14, and propellant 16 are typical components common to center-fired cartridges known in the art. It should be understood by one of ordinary skill in the art that the present invention includes use of the frangible projectile 20 in a full-jacketed cartridge as well as in a rim-fired cartridge which would be substantially identical to the center-fired cartridge, except for the absence of the primer 14.

In operation, a user chambers the cartridge 10 containing the frangible projectile 20 in a weapon suited for the caliber of the cartridge 10. A firing pin in the weapon strikes the primer 14 to ignite the propellant 16 in the casing 12 and propel the frangible projectile 20 from the casing 12 out of the weapon toward the intended target.

As illustrated in FIGS. 1 and 2, the frangible projectile 20 generally comprises primary components 22, a binding component 24, and active components 26. The frangible projectile 20 has a specific gravity comparable to lead, making the projectile compatible with commercially available propellants, yet the projectile is sufficiently hard to withstand firing transients caused by the propellant 16.

The primary components 22 provide the majority of the mass and hardness for the frangible projectile 20. The primary components 22 may be a metal and/or a metal compound or alloy having a specific gravity greater than lead. Before fabrication into the frangible projectile 20, the primary components 22 generally consist of small particles on the order of 0.066 to 0.180 inches in diameter, although smaller or larger particles are within the scope of the present invention. Suitable elements for the primary components 22 may be tungsten, tantalum, and/or compounds or alloys made from these materials such as tungsten-carbide, although other suitable elements are known to one of ordinary skill in the art and within the scope of the present invention.

The binding component 24 is relatively light and soft compared to the primary component 22 and binds the primary component 22 together to form the shape of the frangible projectile 20. The binding component has a specific gravity less than Lead. Suitable elements for the binding component 24 may be tin, aluminum, bismuth, copper, zinc, and/or compounds or alloys made from these materials, although other suitable elements are known to one of ordinary skill in the art and within the scope of the present invention.

The active components 26 consist of the selected agents to be delivered to the target by the frangible projectile 20, depending on the particular application for the frangible projectile 20, as will be explained in more detail later. The active components 26 may exist as part of a homogeneous mixture with the primary 22 and binding 24 components, as shown in FIG. 1. Alternately, the active components 26 may reside separately from the S primary 22 and binding 24 components, in pockets, bores, or other cavities 28 made in the frangible projectile 20, as shown in FIG. 2.

The primary 22, binding 24, and active 26 components adhere together to form the frangible projectile 20 using cold (i.e., room temperature or slightly heated) pressure or swaging. This method of fabrication is well known to one of ordinary skill in the art and is fully described in U.S. Pat. No. 5,963,776 issued to Lowden et al., incorporated herein by reference in its entirety for all purposes. The amount of pressure used in the swaging process may vary according to the particular target, barriers around the target, and intended use for the frangible projectile 20. For example, the fabrication pressure is on the order of 350 MPa, or greater, if the frangible projectile 20 must penetrate a hard target, such as ⅜ inch carbon steel, before franging. Alternately, the fabrication pressure is on the order of 140 MPa if the frangible projectile 20 must frange immediately upon impact with a relatively soft target, such as 1/32 inch sheet-metal. These examples are by way of illustration only and are not intended to limit the scope or meaning of the present invention.

Figure 3A:
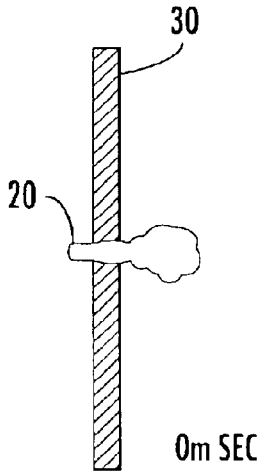
FIGS. 3A, 3B, 3C, and 3D are sequential views of an embodiment of the present invention passing through a target.
Figure 3B:
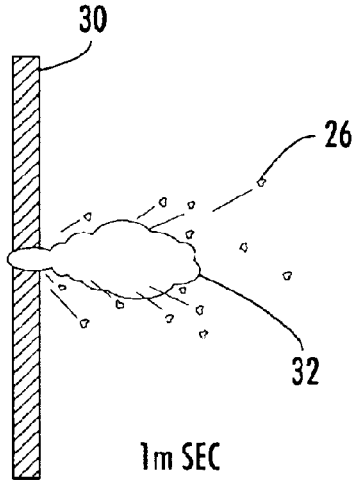
Figure 3C:
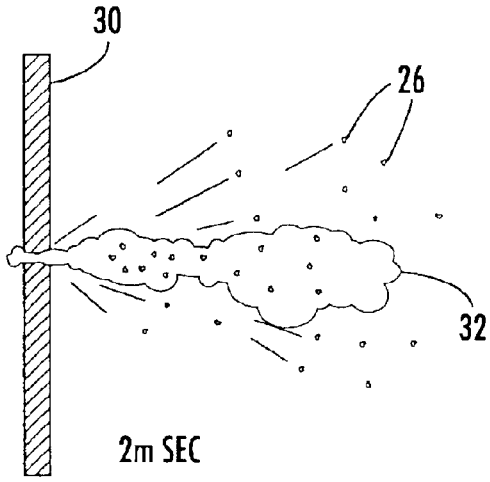
Figure 3D:
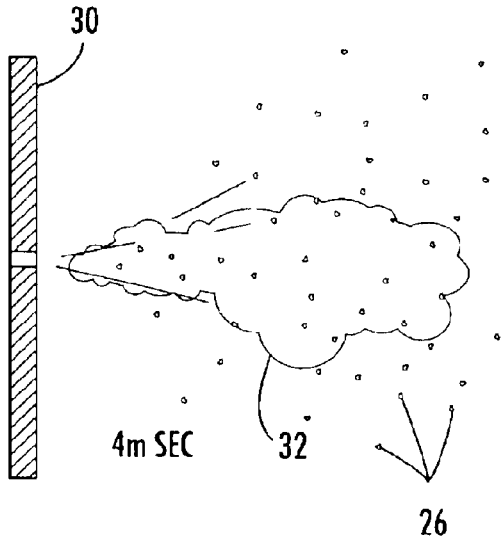

FIGS. 3A, 3B, 3C, and 3D illustrate snapshot depictions at 1 millisecond intervals of one embodiment of the frangible projectile 20 fired through an 18 gauge steel panel 30. The fabrication pressure for this embodiment was approximately 240 MPa to ensure that the frangible projectile 20 penetrated the steel panel 30 before franging. As shown in FIG. 3A, the frangible projectile 20 penetrates most or all of the steel panel 30 before beginning to frange. FIG. 3B shows that as the frangible projectile 20 passes through the steel panel 30, the projectile 20 completely disintegrates to form a cloud 32 of primary and binding components while releasing the active components 26 in the target area. Subsequent snapshots, FIGS. 3C and 3D, illustrate that the cloud 32 continues to expand along the axis of travel, further dispersing the active components 26 in the target area.

Specific embodiments of the frangible projectile 20 may contain various active components 26, depending on the particular use, as will now be described. These examples provide illustrations for specific embodiments and are not intended to limit the scope of the invention to the specific embodiments.

In one embodiment, the frangible projectile 20 includes fluorescent or optical powders as the active components 26. Examples of suitable fluorescent or optical powders include fluoroscene and rhodamine liquid dyes; phosphors and phosphorus powders; diatomaceous earths that include different sub-micron size silica crystals, yttrium, europium; and powdered minerals, for example garnet and sapphire, that emit a specific wave length signature in one of the light wave spectrums, to include ultraviolet, visible, infrared, x-ray, or a blend of the optical powders for a multi-spectral wavelength signature in one or more of the light wave spectrums, although other suitable elements are known to one of ordinary skill in the art and within the scope of the present invention. The optical material emits a fluorescent response with a specific or multi-spectral wavelength signature that can be viewed in the visible light spectrum or detected by sensors in the invisible ultraviolet, infrared, and x-ray electromagnetic spectrums. In this embodiment, penetration of the target by the projectile 20 is generally not desired; therefore, the fabrication pressure for the frangible projectile 20 containing fluorescent or optical powders is the minimum swaging pressure necessary to ensure structural integrity of the projectile 20 until impact with the target.

This embodiment provides a device and method for covertly marking, detecting, monitoring, tracking, and/or identifying a target of interest at significant distances. A user fires the frangible projectile 20 containing the fluorescent or optical powders at the desired target. Upon impact with the target, the frangible projectile 20 breaks apart or franges to release and disperse the fluorescent or optical powders on the target. Once marked, a light source such as a Laser Induced Fluorescent Imaging (LIFI) system can excite the optical marker in the ultraviolet, infrared, or visible light regions of the electromagnetic spectrum with a specific wavelength that yields excitation of the optical marker. The optical marker generates a photon emission that is detectable by a sensor in the invisible regions of the electromagnetic spectrum or becomes visible to the human eye if the fluorescence is emitted in the visible light spectrum.

The light source can excite the optical marker and a detector can detect, monitor, track, and/or identify the marked target based on the specific wavelength emission of the marker or multi-spectral wavelengths emitted by the fluorescence of multiple blended optical materials.

In another embodiment, the frangible projectile 20 includes micron, sub-micron, or nano-powders as the active components 26. The micron, sub-micron, or nano-powders are generally several orders of magnitude smaller than the primary components 22 and are capable of reducing friction and scavenging air or oxygen during an explosive initiation reaction. Examples of suitable micron, sub-micron, or nano-powders include silicone, silica dioxide, silicon carbide, titanium carbide, aluminum nitride, aluminum oxide, titanium dioxide, carbon, boron, aluminum, magnesium, iron, sulfur, or zirconium, although other suitable agents are known to one of ordinary skill in the art and within the scope of the present invention.

This embodiment provides a device and method to neutralize munitions, unexploded ordnance, and/or improvised explosive devices, such as pipe bombs, from a safe, stand-off distance, without causing a high-order (complete combustion of the explosive material) detonation. As previously described, the fabrication pressure for this embodiment depends on the particular explosive material and barriers around the explosive material. For example, if a relatively thin barrier, such as plastic or thin sheet metal, encases the explosive material, lower swaging pressures on the order of 140 MPa would be appropriate to allow the frangible projectile 20 to break apart or frange instantly upon impact and penetration. Alternately, if a relatively thick, hardened barrier, such as carbon-steel, encases the explosive material, higher swaging pressures on the order of 350 MPa, or higher, would be appropriate to allow the frangible projectile 20 to first penetrate the barrier before breaking apart or franging.

A user fires the frangible projectile 20 containing the micron, sub-micron, or nano-powders at a target containing explosive material from a safe, stand-off distance. As the frangible projectile 20 penetrates the target, the projectile breaks apart or franges to disrupt the explosive material and release the micron, sub-micron, or nano-powders in proximity to the explosive material. The released powders disperse over and coat the fractured explosive material. As a result, the powders lubricate the fractured explosive material to mitigate the shock caused by the franged primary 22 and binding 24 components as they move along the axis of travel and continue to disrupt the explosive material. This lubrication also reduces friction between the franged particles and the explosive material, thereby reducing any localized temperature increases. In addition, the powders may scavenge air or oxygen present around the explosive material to prevent a high-order explosion. The result is a low-order detonation and/or no-order detonation and/or nonexplosive burn-out of the explosive material. In this manner, the frangible projectile 20 can neutralize various hazards such as pipe bombs, unexploded ordnance, or virtually any explosive element, from a safe, stand-off distance.

Figure 4A:
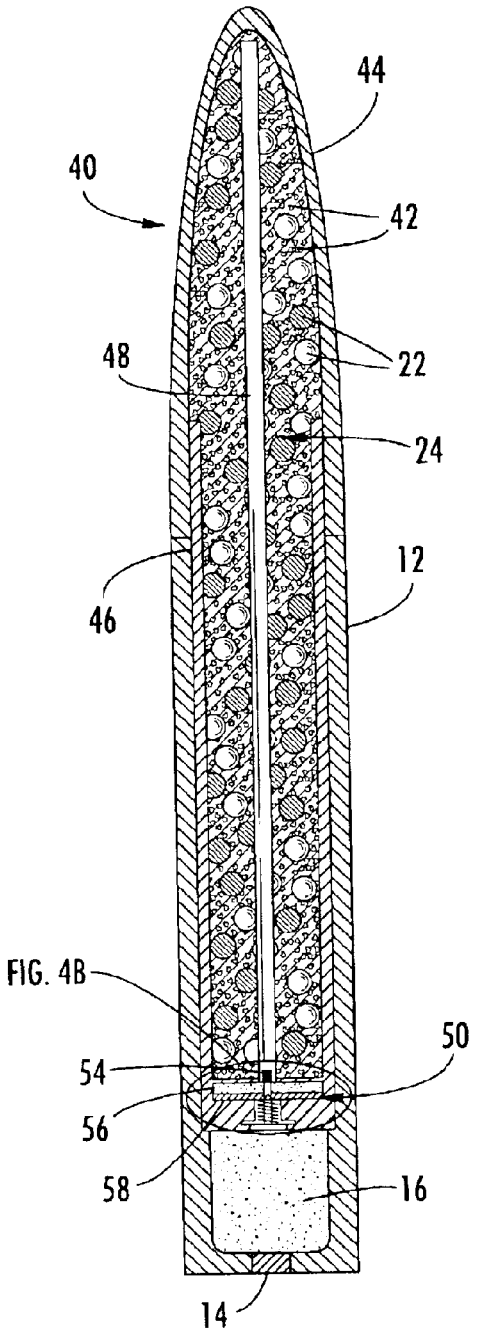
FIGS. 4A and 4B are side plan views of an alternate embodiment of the present invention.
Figure 4B:
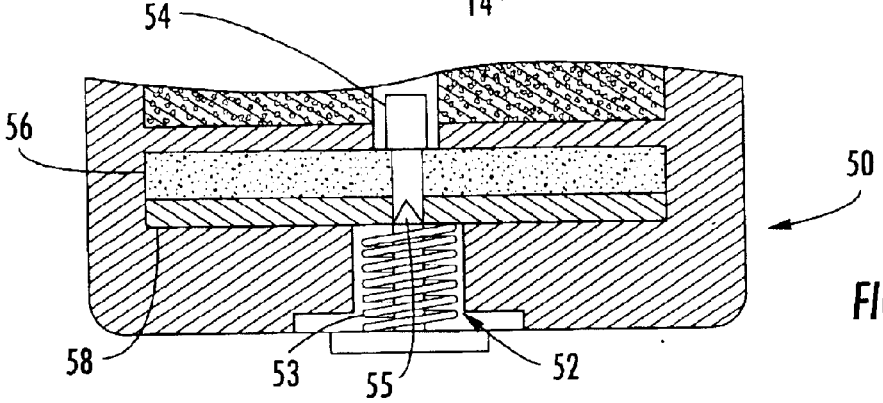

FIGS. 4A and 4B illustrate an alternate embodiment of a frangible projectile 40 containing micron, sub-micron, or nano-powders as the active components 42. This embodiment would be appropriate for neutralizing explosive material encased in virtually any protective barrier in a safe manner from a safe distance.

As shown in FIGS. 4A and 4B, this embodiment further includes a full-metal jacket 44, an internal cup 46, a long rod penetrator 48, and a base fuse initiator 50. Some or all of these additional features may be included in the embodiment, depending on the particular use.

The full-metal jacket 44 surrounds the frangible projectile 40 and protects it from premature frangmentation upon impact with the barrier encasing the explosive material. Examples of materials used for the jacket 44 include copper, aluminum, case-hardened steel, or other suitable casings known to one of ordinary skill in the art and within the scope of the present invention.

The internal cup 46 surrounds the base and may extend along the outer circumference of the frangible projectile 40. The internal cup 46 provides additional structural support for the frangible projectile 40 to further prevent premature fragmentation upon impact with the barrier enclosing the explosive material and to shape or focus the fragmentation along the axis of travel. Examples of materials used for the internal cup 46 include lead, aluminum, copper, case-hardened steel, or other suitable materials known to one of ordinary skill in the art and within the scope of the present invention.

The long rod penetrator 48 resides in a cavity in the frangible projectile 40 and provides additional penetrating ability for the projectile 40 through the barrier encasing the explosive material. Examples of materials used for the long rod penetrator 48 include case-hardened steel, tungsten carbide, or other suitable materials known to one of ordinary skill in the art and within the scope of the present invention.

The base fuse initiator 50 resides at the base of the frangible projectile 40. The base fuse initiator 50 provides a means for more rapidly injecting the frangible projectile 40 including inert nano-powders into the target. As shown in FIG. 4B, the base fuse initiator 50 comprises a spring-loaded plunger 52, a detonator 54, propellant 56, and a backing plate 58.

The spring-loaded plunger 52 provides a variable time delay to allow the frangible projectile 40 and/or the long rod penetrator 48 to pierce the barrier encasing the explosive material before actuating the base fuse initiator 50. The spring-loaded plunger 52 includes a spring 53 attached to a piston 55, although other mechanical assemblies known in the art are suitable substitutes and within the scope of this embodiment. Generally, the strength of the spring 53 and/or the distance between the piston 55 and the detonator 54 determines the time delay for the base fuse initiator.

When the frangible projectile 40 and/or the long rod penetrator 48 impact and pierce the barrier encasing the explosive material, inertia overcomes the spring 53 bias and causes the piston 55 to impact the detonator 54. The detonator 54 then ignites the propellant 56, generating additional force against the backing plate 58. The backing plate 58 may be a separate component or incorporated into and integral with the internal cup 46. The additional force from the propellant 56 against the backing plate 58 accelerates the frangible projectile 40 containing micron, sub-micron, or nano-powders through the barrier and deeper into the explosive material.

Additional embodiments of the frangible projectile 20 may include some or all of the general structure as previously described along with one or more active components 26. For example, the active components 26 may include a polymer or other reactive chemical agent for use with a target containing a fluid, such as Sarin gas or other nerve agents. As the projectile 20 impacts the target containing the fluid, the polymer or other reactive chemical agent coagulates the fluid into a more solid or gelled form to minimize the potential for airborne contamination and facilitate subsequent safe handling and disposal.

It should be appreciated by those skilled in the art that modifications and variations can be made to the embodiments of the invention set forth herein without departing from the scope and spirit of the invention as set forth in the appended claims and their equivalents.

What is claimed is:

1. A frangible projectile for covertly marking a target of interest comprising:

a. primary components having a diameter between approximately 0.066 and 0.180 inches and a specific gravity greater than lead;

b. a binding component substantially coating said primary components, wherein said binding component has a specific gravity less than lead; and c. active components including an optical marker that emits a predetermined wavelength that is not visible to a naked eye, wherein said primary, binding, and active components are cold-pressed to form a ballistic shape having a front end and a distal end.

2. The frangible projectile as in claim 1, wherein said primary components comprise at least one of tungsten, tantalum, or tungsten-carbide.

3. The frangible projectile as in claim 1, wherein said binding component comprises at least one of tin, aluminum, bismuth, copper, or zinc.

4. The frangible projectile as in claim 1, wherein said frangible projectile has a specific gravity approximately equal to lead.

5. The frangible projectile as in claim 1, wherein said active components are substantially homogeneously mixed with said primary and binding components during fabrication.

6. A frangible projectile for preventing a high-order detonation of a target containing explosive material from stand-off distances comprising:

a. primary components having a diameter between approximately 0.066 and 0.180 inches and a specific gravity greater than lead;

b. a binding component substantially coating said primary components, wherein said binding component has a specific gravity less than lead;

c. active components having a diameter less than approximately 0.006 inches, wherein said primary, binding, and active components are cold-pressed to form a ballistic shape having a front end and a distal end.

7. The frangible projectile as in claim 6, wherein said primary components comprise at least one of tungsten, tantalum, or tungsten-carbide.

8. The frangible projectile as in claim 6, wherein said binding component comprises at least one of tin, aluminum, bismuth, copper, or zinc.

9. The frangible projectile as in claim 6, wherein said active components comprise at least one of silicone, silica dioxide, silicon carbide, titanium carbide, aluminum nitride, aluminum oxide, titanium dioxide, carbon, boron, aluminum, magnesium, iron, sulfur, or zirconium.

10. The frangible projectile as in claim 6, wherein said frangible projectile has a specific gravity approximately equal to lead.

11. The frangible projectile as in claim 6, wherein said active components are substantially homogeneously mixed with said primary and binding components during fabrication.

* * * * *